United States Patent [19]

Saito et al.

[11] 4,089,711

[45] May 16, 1978

[54] ANTIFERROMAGNETIC CHROMIUM BASE INVAR-TYPE ALLOYS AND A METHOD OF PRODUCING THE SAME

[75] Inventors: Hideo Saito; Kazuaki Fukamichi; Yoshinobu Saito; Sakae Sugimoto, all of Sendai, Japan

[73] Assignee: The Research Institute for Iron, Steel and Other Metals of the Tohoku University, Sendai, Japan

[21] Appl. No.: 782,906

[22] Filed: Mar. 30, 1977

[30] Foreign Application Priority Data

Apr. 3, 1976 Japan ..... 51-37656

[51] Int. Cl.[2] ..... C22C 28/00; C22D 1/11

[52] U.S. Cl. ..... 148/11.5 R; 75/176; 148/32

[58] Field of Search ..... 75/176; 148/11.5 R, 148/32

[56] References Cited

U.S. PATENT DOCUMENTS

| | | | |
|---|---|---|---|
| 3,008,854 | 11/1961 | Grant et al. | 75/176 |
| 3,015,559 | 1/1962 | McGurty et al. | 75/176 |
| 3,547,713 | 12/1970 | Steinemann et al. | 148/11.5 R |

*Primary Examiner*—W. Stallard

*Attorney, Agent, or Firm*—Fleit & Jacobson

[57] ABSTRACT

Antiferromagnetic chromium base invar-type alloys and a method of producing the same are disclosed. These alloys are produced by adding 0.05–10 wt% of at least one rare earth element to antiferromagnetic chromium base invar-type alloy consisting of 0.5–6 wt% of iron and/or silicon, 1.5–6 wt% of cobalt and/or manganese and remainder of chromium, and then subjecting the resulting alloy ingot to a primary hot working by heating at a temperature of 800°–1200° C, and have a reduction ratio of not less than 60% and a thermal expansion coefficient of not more than $4\times10^{-6}$/° C.

4 Claims, 15 Drawing Figures

ANTIFERROMAGNETIC CHROMIUM BASE INVAR-TYPE ALLOYS AND A METHOD OF PRODUCING THE SAME

BACKGROUND OF THE INVENTION

1. Field of the Invention

The present invention relates to an antiferromagnetic chromium base invar-type alloy and a method of producing the same.

2. Description of the Prior Art

Recently, the inventors have first developed chromium-iron base invar-type alloys (Japanese Patent laid open No. 67110/73, No. 20016/74 and No. 125908/75), chromium-cobalt base invar-type alloys (Japanese Patent laid open No. 55514/75) and chromium-silicon base invar-type alloys (Japanese Patent Application No. 117091/74, No. 138758/74, No. 7878/76 and No. 9912/76) as an antiferromagnetic chromium base invar-type alloy having excellent invar characteristics.

These invar-type alloys have a magnetic susceptibility of $1.5\times10^{-5}$ emu/g (emu is an abbreviation of electric magnetic unit) at maximum, which is $10^{-4}$-$10^{-5}$ times smaller than that of the conventional ferromagnetic invar alloy, so that they may be called as a magnetically insensitive alloy in practice. Therefore, these alloys are considerably interested in the field of precision instrument, control instrument, processing instrument, electronics and the like. However, there is an industrially serious drawback that the workability is defective even when expensive and high-purity chromium is used and particularly when using a commercially available and low-purity chromium, the working is very difficult.

The deterioration of workability of chromium is caused by the fact that chromium has a very strong affinity for non-metallic inclusions such as carbon, nitrogen, oxygen, hydrogen and the like, and that, particularly, the solidification of nitrogens into chromium results in the locking of dislocations. Further, chromium is relatively low in the boiling point and high in the vapor pressure, so that the purification under vacuum is very difficult at high temperature.

Moreover, it is known that the working of chromium is able to be achieved when an ultra-high purity chromium ($c$=30ppm, N<5ppm, O=6ppm) obtained by thermal decomposition of chromium iodide is carefully arc-molten in argon gas atmosphere, but the ultra-high purity chromium is very expensive and then cannot be used ordinarily. Even if another element is added to the ultra-high purity chromium, however, in the most case, the solid solution hardening phenomenon is caused, so that there is no example of working of the invar-type alloys used the ultra-high purity chromium.

SUMMARY OF THE INVENTION

The inventors have made various studies with respect to the antiferromagnetic chromium base invar-type alloy and found out that when at least one rare earth element selected from rare earth elements, a mischmetal and a mother alloy consisting of the rare earth element and chromium is added to a melt of the chromium base invar-type alloy, not only the deoxidation and denitrification sufficiently proceed, but also the residual nitrogen is uniformly dispersed into the matrix as nitride without solid solution, so that the workability is considerably improved. Furthermore, it has been found out that the addition of the rare earth elements improves the invar characteristics in addition to the workability.

According to the present invention, there is provided an antiferromagnetic chromium base invar-type alloy consisting of 0.5–6% by weight of either iron or silicon or both, 1.5–6% by weight of either cobalt or manganese or both, 0.05–10% by weight of at least one rare earth element and remainder of chromium, said alloy having a reduction ratio of not less than 60% and a thermal expansion coefficient of not more than $4\times10^{-6}$/°C. Further, the present invention lies in a method of producing an antiferromagnetic chromium base invar-type alloy, comprising adding 0.05–10% by weight of at least one rare earth element to a melt of an antiferromagnetic chromium base invar-type alloy consisting of 0.5–6% by weight of either iron or silicon or both, 1.5–6% by weight of either cobalt or manganese or both, and remainder of chromium, and then subjecting the resulting alloy ingot to a primary hot working by heating at a temperature of 800°–1200° C to provide a reduction ratio of not less than 60% and a thermal expansion coefficient of not more than $4\times10^{-6}$/° C.

BRIEF DESCRIPTION OF THE DRAWINGS

The invention will now be described with reference to the accompanying drawings, wherein.

DETAILED DESCRIPTION OF THE INVENTION

According to the present invention, the alloy may optionally be molten under vacuum or in a reduced atmosphere or in a nutral atmsophere.

During the melting, at least one rare earth element is added to the melt as a simple substance or a composite substance such as mischmetal or a mother alloy consisting of chromium and the rare earth elements. Among the rare earth elements, lanthanum (La), yttrium (Y), cerium (Ce), praseodymium (Pr), samarium (Sm), europium (Eu), gadolinium (Gd) and dysprosium (Dy) are particularly effective.

As chromium to be molten, use can be made of the high-purity chromium and the commercially available and low-purity chromium.

According to the present invention, the primary hot working may be effected by holding the resulting alloy ingot at a high temperature above 800° C and then working at a reduction ratio of at least 60%, for example, by hot compression at a low working speed because the alloy of this type is brittle and the forging and rolling are difficult. When the primary hot working is satisfactorily carried out, then a secondary working can easily be performed at a relatively low temperature.

The addition effect of the rare earth element influencing upon the primary workability of antiferromagnetic Cr-Fe-Mn and Cr-Fe-Co invar-type alloys will be described below. In the following examples, there is used the commercially available chromium (C:0.021%, Si:0.011%, P:0.002%, S:0.015%, Fe:0.2%, Al:0.004%, Cu:0.0004%, Pb:0.001%, H:0.0008%, N:0.05%, O:0.06%, Cr:remainder).

At first, 1.2 kg of antiferromagnetic Cr-4.5%Fe-1.0%Mn invar-type alloy is induction-molten in argon gas atmosphere and lanthanum is added as in the state of the mother alloy with chromium by varying the amount of lanthanum within a range of 0–10% by weight based on the alloy to form an alloy ingot. Thereafter, a specimen having a diameter of 8mm and a length of 10mm is cut out from the alloy ingot and then subjected to a compression forming at a temperature of 800°–1300° C and a reduction ratio of 50% by means of a high-temperature compression test machine. The relationship between the critical crack limit and the addition amount of lanthanum in the hot working of the specimen is shown in FIG. 1.

Figure 1:
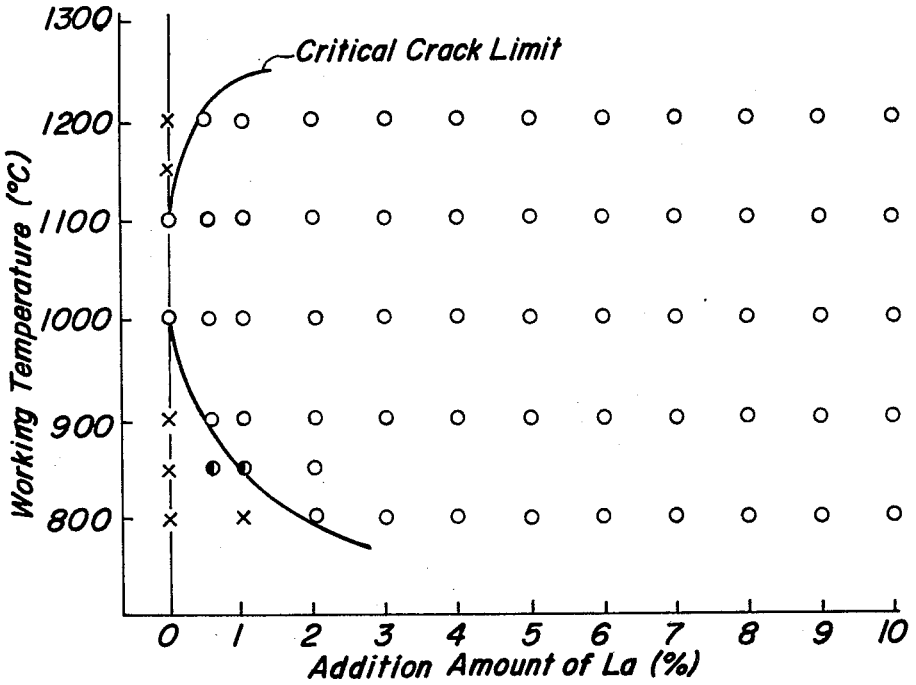
FIG. 1 is a graphical representation showing a relationship between the addition amount of lanthanum and the critical crack limit temperature in the Cr-4.5%Fe-1%Mn invar-type alloy at a reduction ratio of 50%.

In FIG. 1, symbol ○ shows no crack, symbol ◐ shows fine cracks, symbol Δ shows slightly large cracks and symbol × shows large cracks. These symbols are also adopted throughout the different figures of the drawing.

As seen from FIG. 1, when lanthanum is not added to the alloy, the hot working is only achievable at a temperature of 1000°–1100° C, but the addition of lanthanum makes it possible to considerably widen the range of the working temperature. Moreover, the feature that the hot working becomes impossible at 1300° C is considered to be due to the precipitation of the residual rare earth element or the nitride with the rare earth element, while the hot working at lower temperature is difficult due to the hardening of the material.

Figure 2:
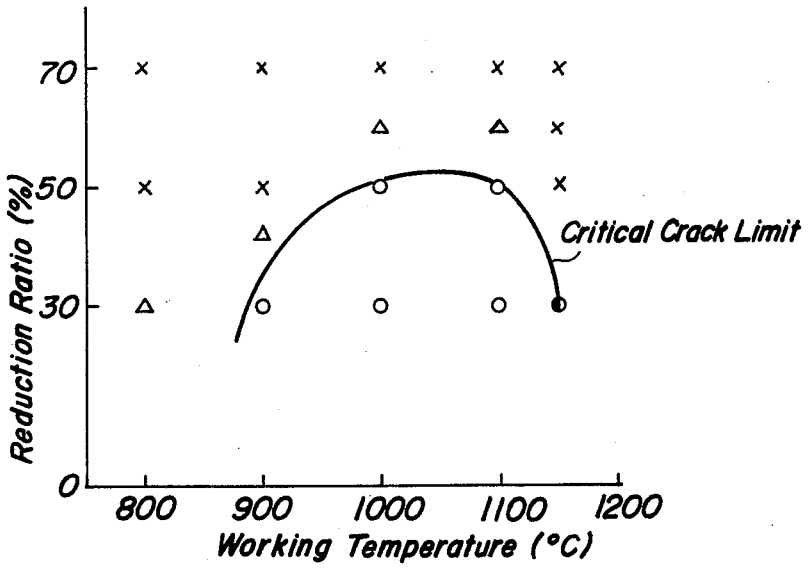
FIG. 2 is a graphical representation showing a relationship between the reduction ratio and the working temperature for critical crack limit of the Cr-4.5%Fe-1%Mn invar-type alloy.

The relationship between the reduction ratio and the working temperature in the Cr-4.5%Fe-1.0%Mn invar-type alloy containing no rare earth element is shown in FIG. 2. As seen from FIG. 2, the hot working at a low reduction ratio of 30% is possible above 900° C, but the hot working at a reduction ratio of 50% is restricted to the temperature of 1000°–1100° C such as shown in FIG. 1.

Figure 3:
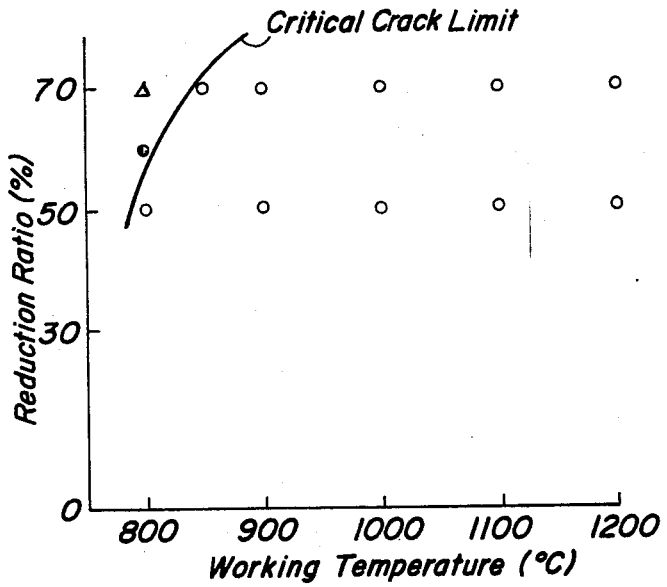
FIG. 3 is a graphical representation showing a relationship between the reduction ratio and the working temperature for critical crack limit of the Cr-4.5%Fe-1%Mn invar-type alloy containing 3% of lanthanum.

When 3% of lanthanum is added to the Cr-4.5%Fe-1.0%Mn invar-type alloy, the hot working range is considerably widened as shown in FIG. 3. The hot working at a high reduction ratio of 70% is possible above 850° C.

Figure 4:
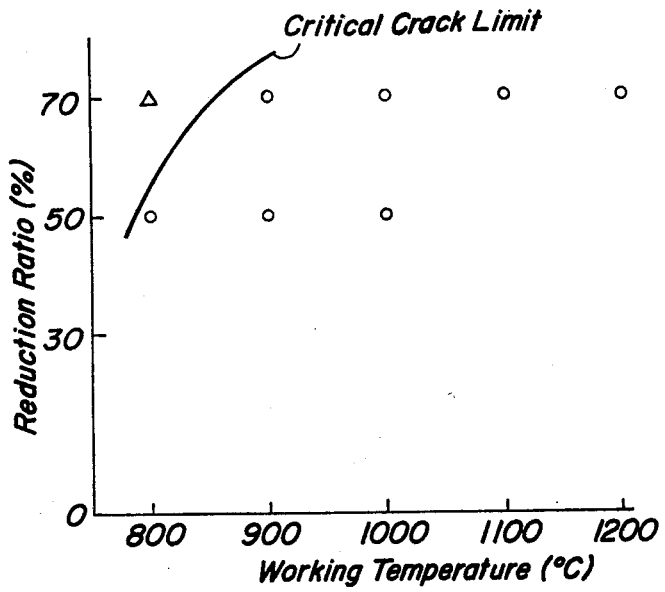
FIG. 4 is a graphical representation showing a relationship between the reduction ratio and the working temperature for critical crack limit of the Cr-4.5%Fe-1%Mn invar-type alloy containing 2% of lanthanum.

700g of the Cr-4.5%Fe-1.0%Mn invar-type alloy is arc-molten in argon gas atmosphere and 2% of metallic lanthanum is added to form an alloy ingot. The specimen of the alloy ingot is subjected to the compression forming in the same manner as described above to obtain a relationship between the critical crack limit and the working temperature as shown in FIG. 4. That is, it can be seen from FIG. 4 that cracks are only generated at the temperature of 800° C and the reduction ratio of 70%, while the reduction ratio of more than 70% is achievable at any temperature above 900° C.

As mentioned above, the addition of lanthanum exerts a great influence on the workability, while the addition amounts of iron and manganese, which are alloying elements, hardly act on the workability.

Next, the effect of the rare earth element on the deoxidation and denitrification of the alloy will be described with reference to FIGS. 5 and 6.

Figure 5:
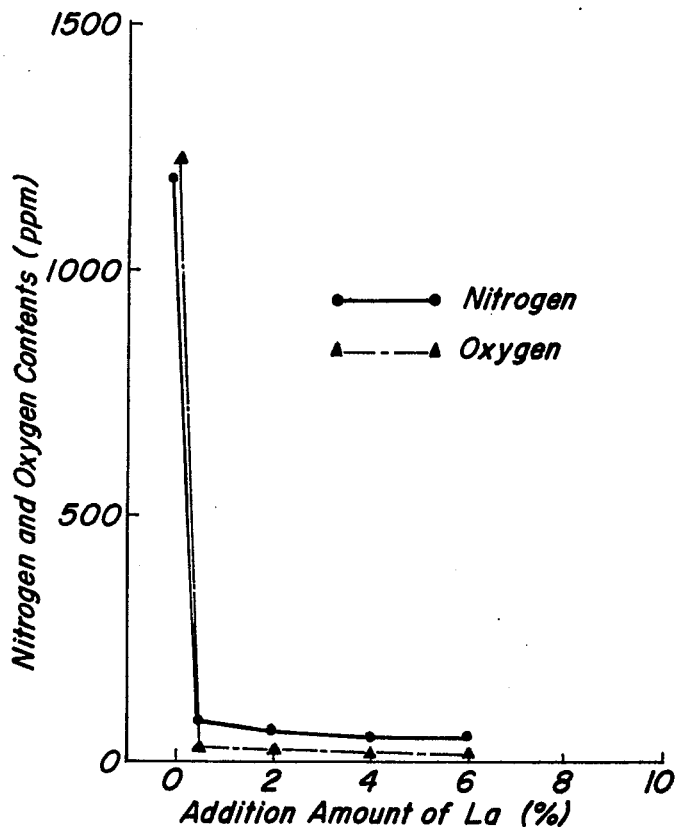
FIG. 5 is a graphical representation showing a relationship between the addition amount of lanthanum and the nitrogen and oxygen contents in the Cr-4.5%Fe-1%Mn invar-type alloy.

FIG. 5 shows the influence of lanthanum addition on the nitrogen and oxygen contents in the antiferromagnetic Cr-4.5%Fe-1.0%Mn invar-type alloy. As seen from FIG. 5, the addition of only 0.5% of lanthanum decreases each of the nitrogen and oxygen contents to less than 100ppm corresponding to about twelfth of that in the case containing no lanthanum, which is considered to be a decisive factor for the improvement of the workability.

Figure 11:
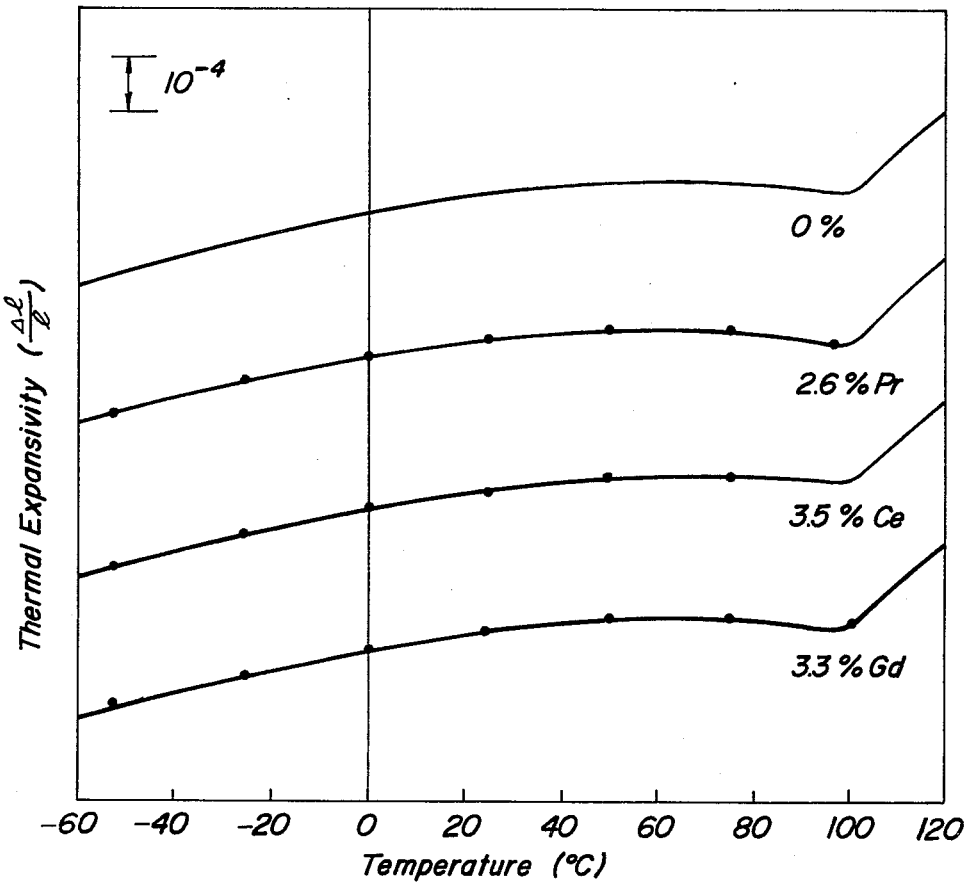
FIG. 11 is a graphical representation showing an influence of the addition amounts of various rare earth elements upon the thermal expansion coefficient of the Cr-4.5%Fe-1%Mn invar-type alloy.

Even when praseodymium (Pr), cerium (Ce), gadolinium (Gd), yttrium (Y) or the like is used instead of lanthanum, the similar result is obtained as seen from the following FIG. 11.

Figure 6:
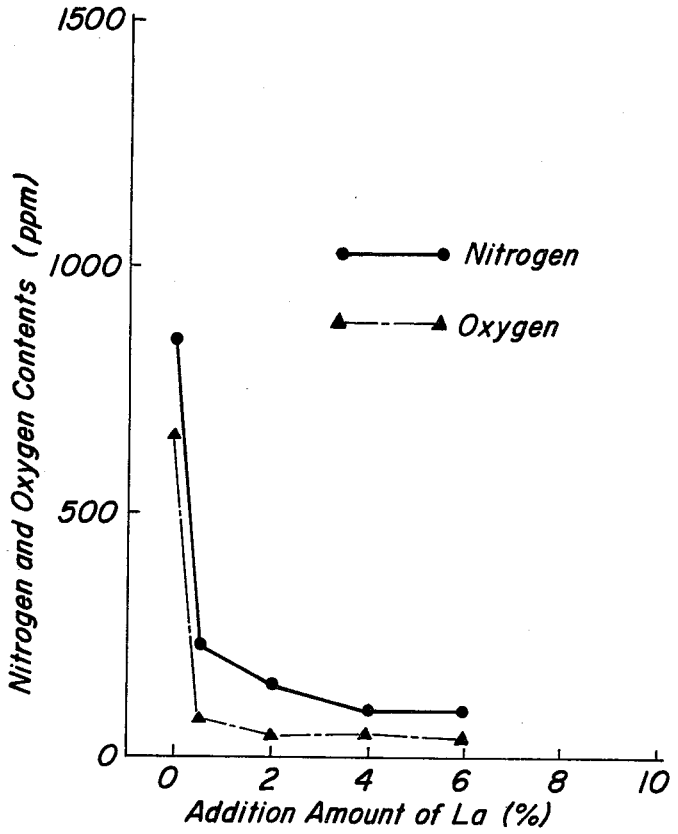
FIG. 6 is a graphical representation showing a relationship between the addition amount of lanthanum and the nitrogen and oxygen contents in the Cr-2%Fe-2%Co invar-type alloy.

FIG. 6 shows the change of the nitrogen and oxygen contents in the antiferromagnetic Cr-2%Fe-2%Co invar-type alloy when lanthanum is added to this alloy. Although the addition effect of lanthanum is somewhat inferior to that shown in FIG. 5, the decrease of the nitrogen and oxygen contents is remarkable. The results after the hot working of this alloy are shown in FIGS. 7 and 8, respectively.

Figure 7:
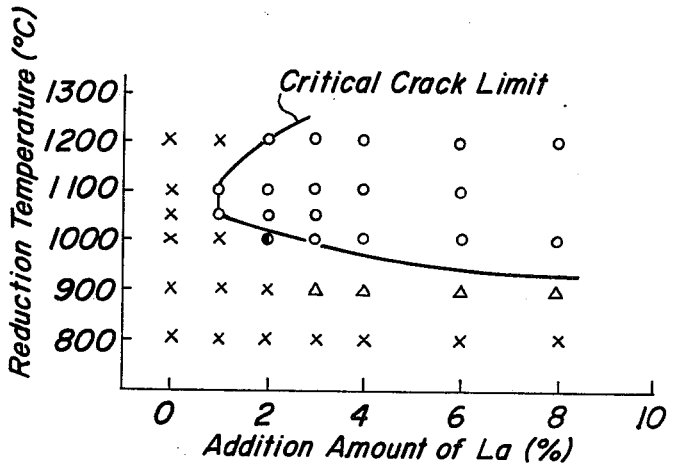
FIG. 7 is a graphical representation showing a relationship between the addition amount of lanthanum and the critical crack limit temperature in the Cr-2%Fe-2%Co invar-type alloy.

FIG. 7 shows a possible hot working range at a reduction ratio of 50% when lanthanum is added to the Cr-2%Fe-2%Co invar-type alloy. The working method is the same as in FIG. 1. Since the Cr-Fe-Co alloy is fairly harder than the Cr-Fe-Mn alloy, the reduction ratio of 50% is impossible in case of adding no rare earth element, while by adding 1% of lanthanum, the compression forming is first achievable only at a temperature of 1000°-1100° C. However, the hot working can not be effected at a temperature below 900° C independently of the addition amount of lanthanum.

Figure 8:
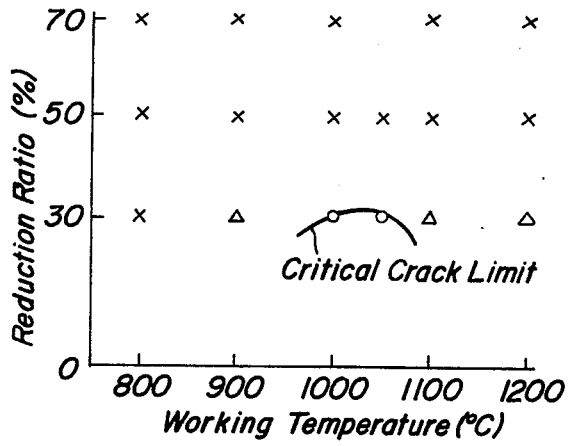
FIG. 8 is a graphical representation showing a relationship between the reduction ratio and the working temperature for critical crack limit of the Cr-2%Fe-2%Co invar-type alloy.

FIG. 8 shows the relationship between the reduction ratio and the working temperature of the Cr-2%Fe-2%Co invar-type alloy containing no rare earth element. As seen from FIG. 8, the reduction ratio of 30% is only achievable at a temperature of 1000°-1100° C.

Figure 9:
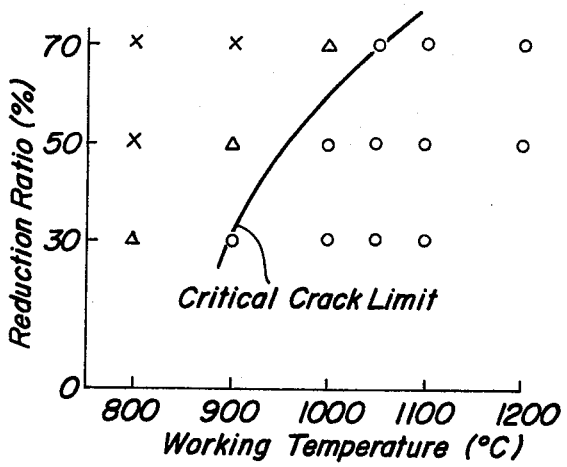
FIG. 9 is a graphical representation showing a relationship between the reduction ratio and the working temperature for critical crack limit of the Cr-2%Fe-2%Co invar-type alloy containing 4% of cerium.

FIG. 9 shows an example of adding 4% of cerium to the antiferromagnetic Cr-2%Fe-2%Co invar-type alloy. It can be seen from FIG. 9 that the reduction ratios of 30%, 50% and 70% are first achievable at temperatures of 900° C, 950° C and 1050° C, respectively. A similar result is obtained when praseodymium, yttrium, gadolinium or the like is used instead of cerium.

The effect of the rare earth element influencing upon the thermal expansion coefficients of antiferromagnetic Cr-Fe-Mn and Cr-Fe-Co invar-type alloys will be described below.

Figure 10:
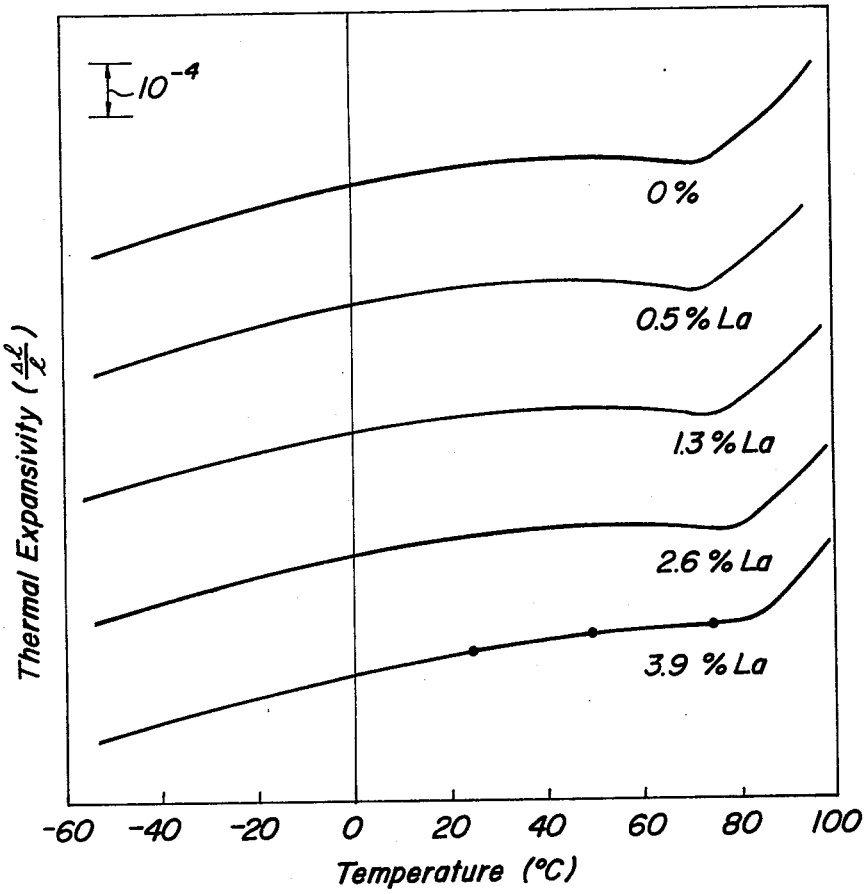
FIG. 10 is a graphical representation showing an influence of the addition amount of lanthanum upon the thermal expansion coefficient of the Cr-4.5%Fe-1%Mn invar-type alloy.

In FIG. 10, the thermal expansion coefficient of the antiferromagnetic Cr-4.5%Fe-1% Mn invar-type alloy is compared with those of the alloys containing 0.5-3.9% of lanthanum. It can be seen from FIG. 10 that the rare earth element is almost consumed for the deoxidation and denitrification and hardly acts on the thermal expansion coefficient.

FIG. 11 shows an example of adding 2.6% of praseodymium, 3.5% of cerium or 3.3% of gadolinium to the Cr-4.5%Fe-1%Mn invar-type alloy. In this example, there is no change of the thermal expansion coefficient. Therefore, the addition effect of these elements is the same as that of lanthanum.

Figure 12:
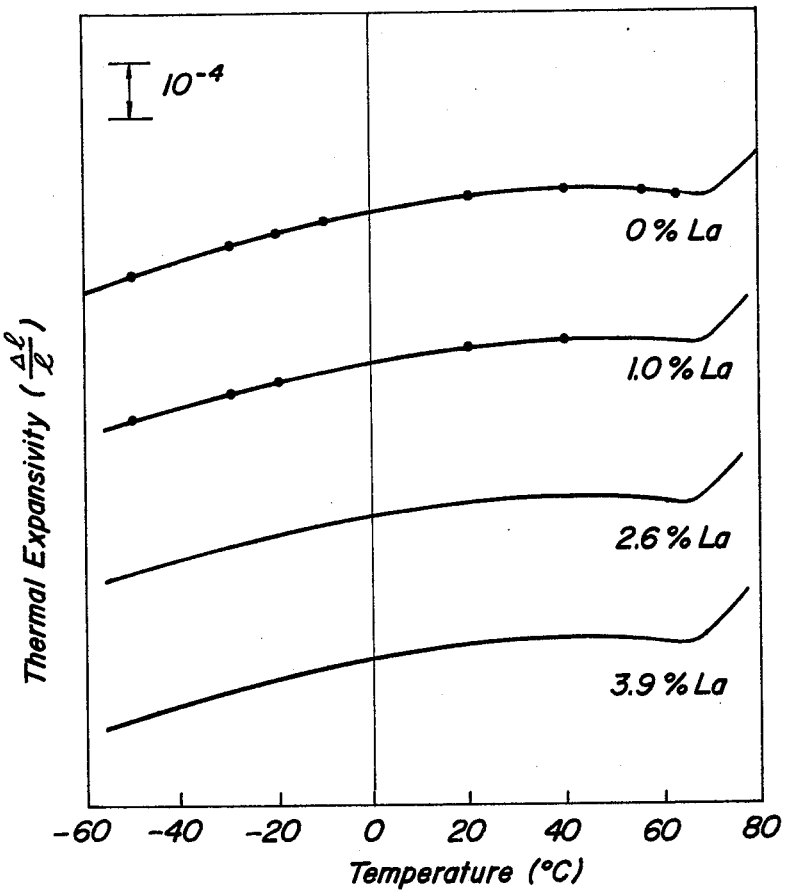
FIG. 12 is a graphical representation showing an influence of the addition amount of lanthanum upon the thermal expansion coefficient of the Cr-2%Fe-2%Co invar-type alloy.
Figure 13:
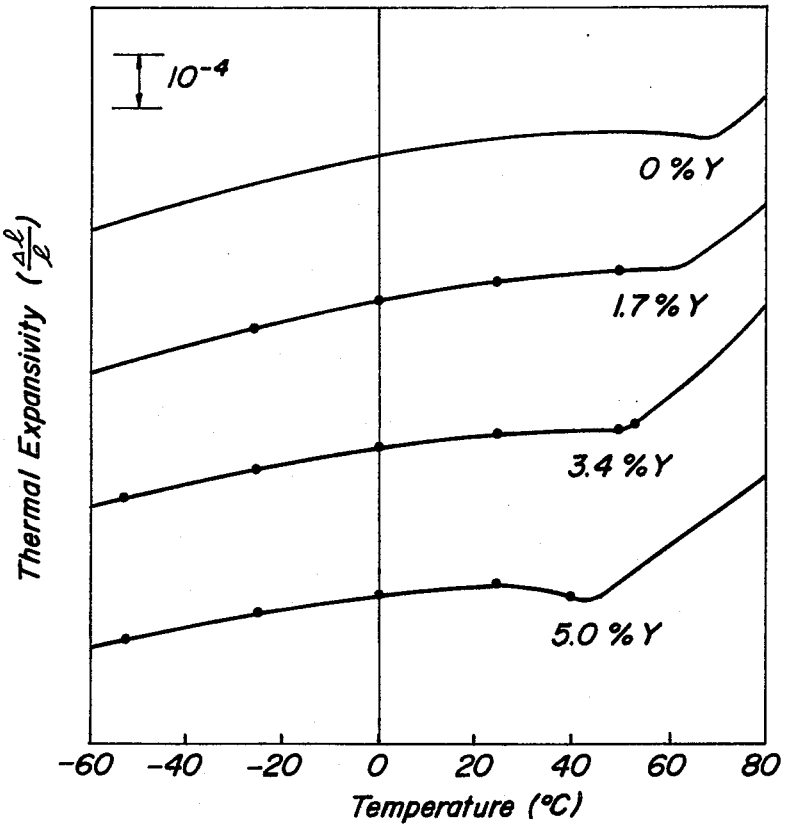
FIG. 13 is a graphical representation showing an influence of the addition amount of yttrium upon the thermal expansion coefficient of the Cr-2%Fe-2%Co invar-type alloy.

FIGS. 12 and 13 show examples of adding 0-3.9% of lanthanum and 0-5% of yttrium to the antiferromagnetic Cr-2%Fe-2%Co invar-type alloy, respectively. It can be seen from FIGS. 12 and 13 that the addition of the rare earth element hardly exerts on the thermal expansion coefficient. In other words, it is clear that the rare earth element added is almost consumed for the deoxidation and denitrification.

Figure 14:
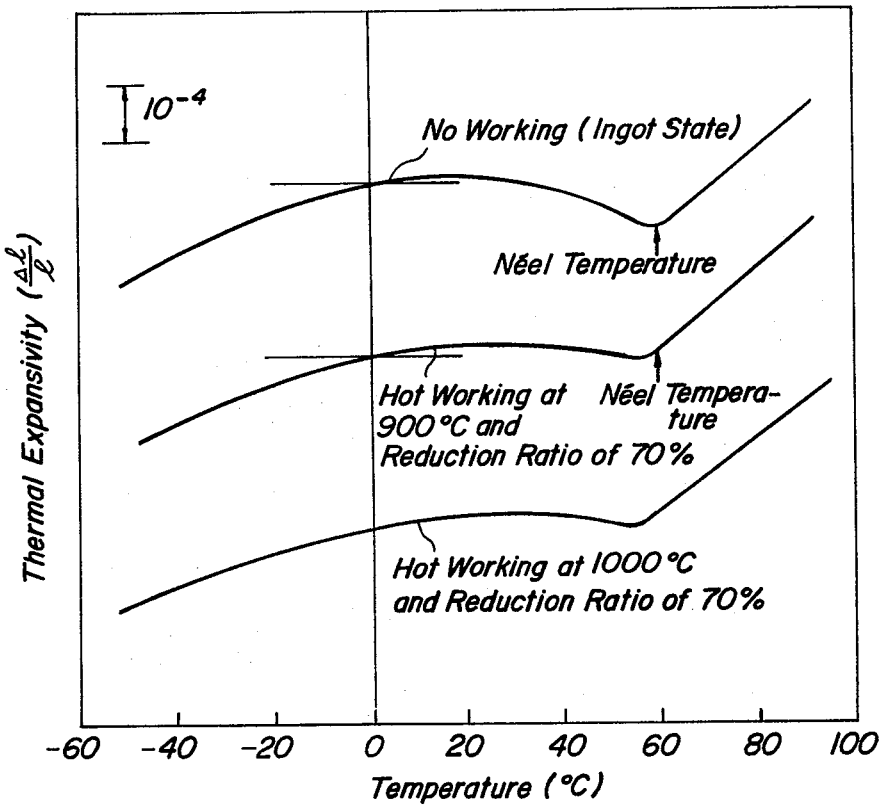
FIG. 14 is a graphical representation showing an influence of the hot working upon the thermal expansion coefficient of the Cr-5%Fe-0.6%Mn invar-type alloy containing 2% of lanthanum.

In FIG. 14, the thermal expansion coefficient of the antiferromagnetic Cr-5.0%Fe-0.6%Mn invar-type alloy containing 2% of lanthanum are shown when this alloy is not worked or worked at 900° C and 1000° C at a ratio of 70%. As seen from FIG. 14, the curve of thermal expansion coefficient considerably bends below Neel temperature in case of the alloy ingot, i.e. no-working alloy, but when the alloy ingot is subjected to a hot working, the curve becomes very flat, so that the hot working considerably contributes to the improvement of the thermal expansion coefficient. Moreover, the alloy after worked at 1000° C has a curve of thermal expansion coefficient flater than that after worked at 900° C and exhibits excellent invar characteristics over a wide temperature range.

Figure 15:
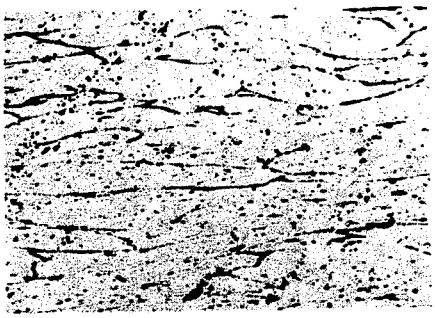
FIG. 15 is a photograph showing the microscopic structure of the Cr-5%Fe-0.6%Mn invar-type alloy containing 2% of lanthanum, which is hot worked at a temperature of 1000° C and a reduction ratio of 70%.

The microscopic structure of the alloy after worked at 1000° C as described above is shown as a photograph in FIG. 15. As seen from FIG. 15, the microscopic structure of the alloy seems to be a fiber-like by compression forming. Therefore, such excellent invar characteristics are considered to be due to the fact that the spin distribution of the antiferromagnetic alloy is somewhat changed by the above microscopic structure like the so-called $\Delta\alpha$ effect caused by rolling the ferromagnetic alloy.

What is claimed is:

1. An antiferromagnetic chromium base Invar-type alloy consisting of 0.5-6% by weight of either iron or silicon or both, 1.5-6% by weight of either cobalt or manganese or both, 0.05-10% by weight of at least one rare earth element and remainder of chromium, said alloy having a reduction ratio of not less than 60% and a thermal expansion coefficient of $4\times10^{-6}/°$ C.

2. A method of producing an antiferromagnetic chromium base invar-type alloy, comprising adding 0.05-10% by weight of at least one rare earth element to a melt of an antiferromagnetic chromium base invar-type alloy consisting of 0.5-6% by weight of either iron or silicon or both, 1.5-6% by weight of either cobalt or manganese or both and remainder of chromium, and then subjecting the resulting alloy ingot to a primary hot working by heating at a temperature of 800°-1200° C to provide a reduction ratio of not less than 60% and a thermal expansion coefficient of not more than $4\times10^{-6}/°$ C.

3. A method as claimed in claim 2, wherein said rare earth element is selected from rare earth elements, mischmetal and mother alloy consisting of chromium and rare earth elements.

4. A method as claimed in claim 3, wherein said rare earth element is selected from the group consisting of lanthanum, yttrium, cerium, praseodymium, samarium, europium, gadolinium and dysprosium.

* * * * *